United States Patent [19]

Panetti

[11] 4,074,468

[45] Feb. 21, 1978

[54] APPARATUS FOR THE CONTINUOUS ON-TRACK TRUING OF RAILWAY RAILS

[76] Inventor: Romolo Panetti, 24 Parc Chateau Banquet, Geneva, Switzerland

[21] Appl. No.: 595,685

[22] Filed: July 14, 1975

[30] Foreign Application Priority Data

Jan. 13, 1975 Switzerland ..... 337/75

[51] Int. Cl.[2] ..... B24B 23/00

[52] U.S. Cl. ..... 51/178

[58] Field of Search ..... 51/178

[56] References Cited

U.S. PATENT DOCUMENTS

| | | | |
|---|---|---|---|
| 2,018,411 | 10/1935 | Miller | 51/178 |
| 2,197,729 | 4/1940 | Miller | 51/178 |
| 2,741,883 | 4/1956 | Scheuchzer et al. | 51/178 |
| 2,779,141 | 1/1957 | Speno et al. | 51/178 |
| 3,358,406 | 12/1967 | Speno et al. | 51/178 |
| 3,526,997 | 9/1970 | Panetti | 51/178 |
| 3,707,808 | 1/1973 | Danko et al. | 51/178 |
| 3,738,066 | 6/1973 | Panetti | 51/178 |
| 3,888,052 | 6/1975 | Panetti | 51/178 |
| 3,974,597 | 8/1976 | Hambrick et al. | 51/178 |

FOREIGN PATENT DOCUMENTS

| | | | |
|---|---|---|---|
| 158,513 | 12/1962 | U.S.S.R. | 51/178 |

*Primary Examiner*—James L. Jones, Jr.
*Attorney, Agent, or Firm*—Haseltine, Lake & Waters

[57] ABSTRACT

Apparatus for the continuous on-track truing of railway rails comprising a plurality of rail following elements at least some of which are adapted to abrade or grind a rail. The elements are divided into at least two independently movable groups and such movement is controlled so that the rail contacting zones of the respective groups remain parallel. The force which the respective groups exert on the rail to be trued is proportioned.

2 Claims, 16 Drawing Figures

APPARATUS FOR THE CONTINUOUS ON-TRACK TRUING OF RAILWAY RAILS

FIELD OF THE INVENTION

The present invention relates to apparatus for the continuous on-track truing of railway rails.

BACKGROUND

Various apparatus for this purpose are known. For example, it has already been proposed to operate with individual grinders or abrasive blocks, but they have the drawback of tending to follow the undulations of the rail against which they are applied. In order to overcome this disadvantage, shoes of a certain length have been used which support several individual abrasive blocks or grinders in a rigid linear array extending in the direction of the track. By virtue of their length, these shoes tend to diminish the disadvantage mentioned above although, depending on the length of the shoe relative to the length of the undulations, the shoe may follow the latter, if, as is usual, it has an articulated suspension from the carrying vehicle.

It has also been proposed to use shoes which support grinders at distances which are variable longitudinally of the rail direction in order to avoid the resonance phenomena which can occur with certain spacing of the grinders for particular lengths of rail undulations.

In order simultaneously to eliminate the shortest as well as the longest of these undulations, it is necessary to provide very long shoes having a great number of points at which they contact the rail. These points may be provided by abrasive blocks of grindstones, and also by rail-following wheels, shoes or other non-abrasive sensors.

However, by increasing the number of rail contacting points and at the same time providing a supporting frame to maintain them in a plane which is always parallel with the rail, a further difficulty is encountered.

Namely, since there can be considerable variations in length of the undulations and the size of hollows and humps which are to be straightened and, particularly when there is a long undulation of considerable amplitude, it can happen that the whole assembly will only rest on two or perhaps only one point, that is at the apex of the undulation. Once everything has been regulated to exert a given pressure on the rail (a pressure normally determined and distributed according to the number of intended rail contacting points) this pressure may occasionally be concentrated entirely at a single, or perhaps only two, rail contacting points.

Thus with a pressure normally distributed, for example, over five grinders, it is highly probable that, at certain times, one of the grinders may have to withstand up to five times its normal working pressure. This can result in the burning of the working surface of the rail and it may severely damage the grinder.

SUMMARY OF THE INVENTION

It is an object of the present invention to alleviate this problem.

According to the present invention there is provided apparatus for the continuous on-track truing of railway rails, comprising a plurality of rail following elements, at least some of which are adapted to abrade or grind the rail, and said elements being divided into at least two independently movable groups, means governing such movement so that the rail contacting zones of respective groups remain parallel, and means for proportioning the force which the respective groups exert on the rail to be trued.

Thus, for example, with five rail contacting points provided by grinders, abrasive blocks, contact rollers, shoes or other sensors, this number may be divided into two groups, the first group being composed of three elements and the second of two elements. The maximum possible loading exerted by the group of three elements at two or one single bearing point will not exceed three times the normal evenly distributed working pressure.

BRIEF DESCRIPTION OF THE DRAWING

For a better understanding of the invention, several constructional forms will now be described, by way of example, with reference to the accompanying diagrammatic drawings, in which.

DETAILED DESCRIPTION

Figure 1:
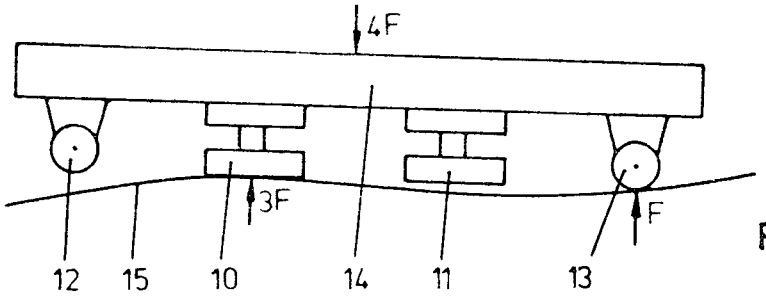
Fig.1 PRIOR ART
FIG. 1 shows a conventional rail truing apparatus.

In a conventional arrangement as shown in FIG. 1, two grinders 10, 11 and two rail following wheels 12, 13 are carried in line by a common chassis 14, which is guided along the rail 15 in which there are undulations. In the situation in FIG. 1 the hump of one of these undulations is below the grinder 10, and this results in the adjacent wheel 12 and the other grinder 11 being raised clear of the rail.

With a designed four-point support, it will be convenient to assume that the chassis presses on the rail with a total downward force 4F. In the FIG. 1 position, the distances between bearing points being equal, it is seen that the grinder 10 will exert a force 3F on the rail 15 and the wheel 13 a force F. The force 3F exerted by the grinder is excessive and it will tend to burn the rail, and perhaps even damage the grinder.

Figure 2:
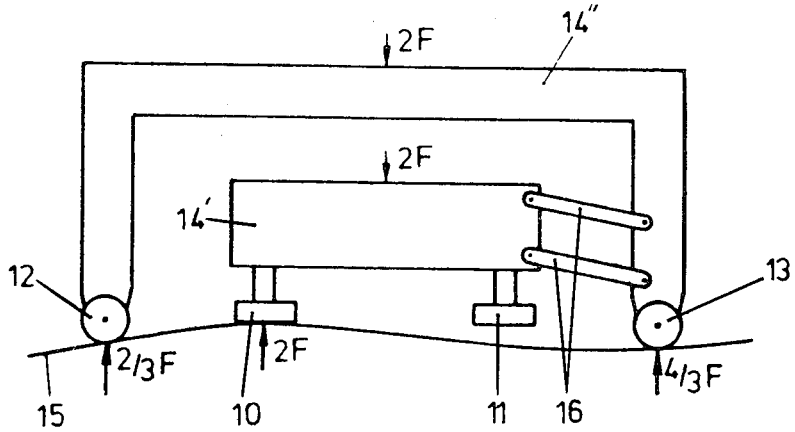
FIG. 2 shows rail truing apparatus with a similar arrangement of rail contacting elements, but mounted according to the invention.

The same wheel and grinder spacing is illustrated in FIG. 2 but here the grinders 10 and 11 form an assembly carried by a first chassis 14' while the wheels 12, 13 form another assembly carried by a second chassis 14''. Each chassis will exert one-half the total downward force, in other words 2F each. The grinder 10 is again shown over the hump in the rail 15.

It is seen that this grinder 10 will exert a maximum downward force of 2F, while in the situation shown the wheels 12 and 13 will exert a downward force equal to 2/3F and 4/3F respectively.

A parallel bar linkage 16 connects the chassis 14' and 14" and will ensure they are maintained in parallel, whatever the slope and undulation of the rail.

Figure 3:
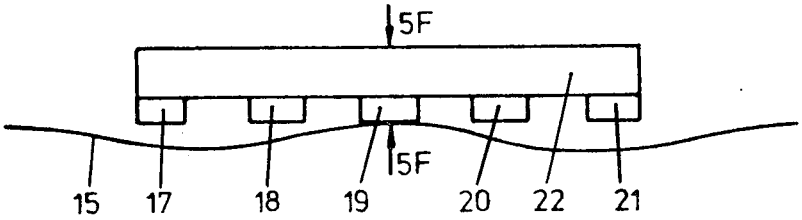
FIGS. 3 and 4 are similar comparative diagrammatic illustrations of another arrangement of rail contacting elements.
Figure 4:
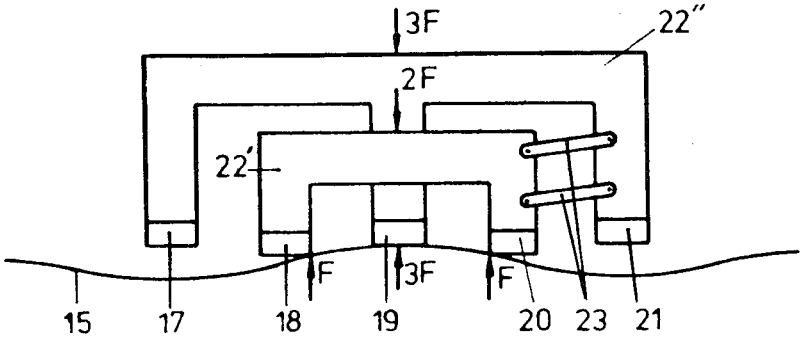

Similarly to the above, FIGS. 3 and 4 show the cases where there is a designed five-point contact.

In FIG. 3, five grinders 17, 18, 19, 20 and 21 are rigidly mounted on a single chassis 22, and exert a total downward force 5F. It will be seen that the entire force can be instantaneously applied through a single grinder, here the grinder 19, when the latter passes over a hump in the rail 15.

By modifying the assembly to the arrangement shown in FIG. 4, that is to say by mounting two grinders 18, 20 on a common chassis 22' and three grinders 17, 19, 21 on a second chassis 22", the first chassis transmits the force 2F and the second the force 3F. In the situation corresponding to FIG. 3, the central grinder 19 will be subject to the maximum force 3F while the adjacent grinders 18 and 20 on the chassis 22' will each be subject to a force F. The chassis move in parallel with each other by virtue of parallel bar linkage 23.

Figure 5:
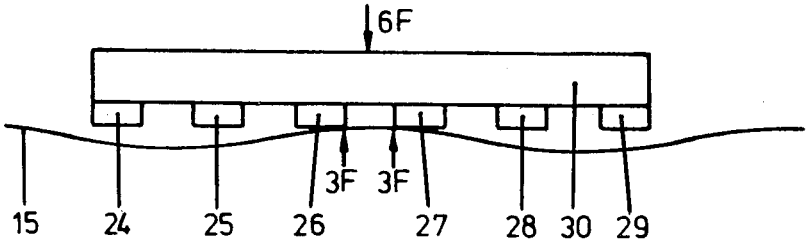
FIGS. 5 and 6 are further similar comparative diagrammatic illustrations of yet another arrangement of rail contacting elements.
Figure 6:
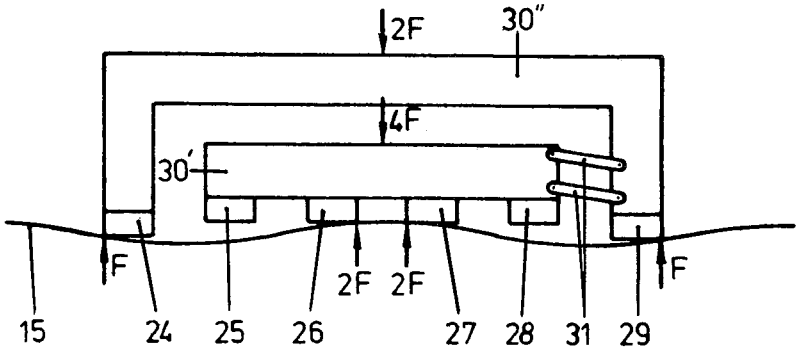

FIGS. 5 and 6 show equivalent arrangements with six grinders. It will be understood that there can be any number and combinations of grinders and rail following wheels susceptible to this principle of chassis-dividing.

In FIG. 5, grinders 24, 25, 26, 27, 28 and 29 are carried by a single chassis 30, which exerts a total downward force 6F. It can happen that this is split between just two grinders 26, 27, so that each transmits a force 3F, as shown in the Figure.

In FIG. 6 these grinders are divided into two groups, so that four are carried by a chassis 30' and the other two by a second chassis 30", connected to the first by a parallel bar linkage 31. With the undulations as shown, the grinders 26, 27 each transmit force 2F and the grinders 24, 29, force F. It will be understood that the force distribution between chassis is in proportion to the numbers of points of contact with the rail 15 associated with them.

There will now be described five additional arrangements where grinders and other elements providing points of contact are divided into several groups with various distributions. There will be no indication of the forces applied to the rail but, as has just been seen, they will always be less than the greatest possible force that could occur if all the points of contact were maintained with a rigid relationship.

Figure 7:
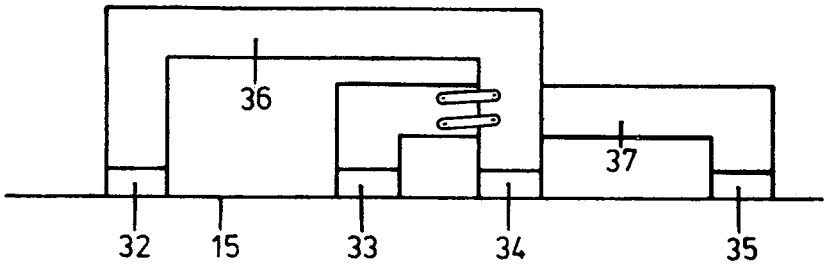
FIGS. 7 to 11 show rail truing apparatus with various arrangements of rail contacting elements, each mounted according to the invention.

In FIG. 7, four contact points provided by grinders 32, 33, 34, 35 are divided into two groups of two, the contact points of these two groups alternating one with another. Chassis 36 carries the grinders 32 and 34 in overlapping relationship with chassis 37 carrying the grinders 33 and 35.

Figure 8:
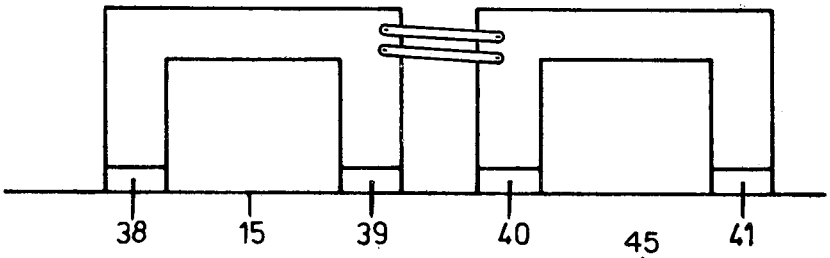

In FIG. 8, four grinders 38, 39, 40, 41 are divided into two groups 38, 39 and 40, 41 respectively. The groups do not alternate or overlap, but are spaced longitudinally of the rail.

Figure 9:
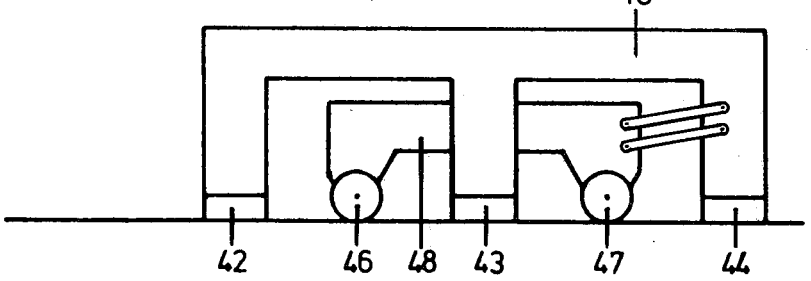

In FIG. 9, three grinders 42, 43, 44 are carried by a chassis 45 and alternate with two rail following wheels 46, 47 carried by a second chassis 48. Therefore, there are five contact points divided into overlapping groups of two and three.

Figure 10:
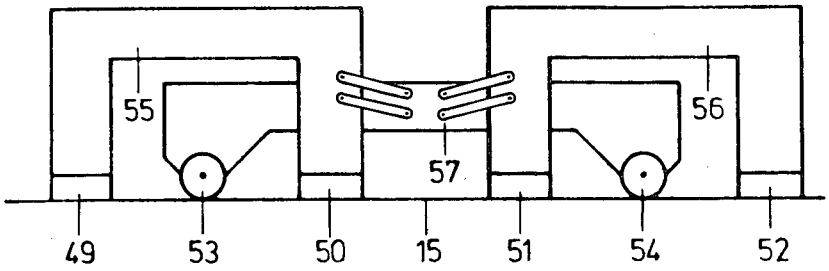

In FIG. 10 six points of contact are distributed into three groups of two. There are two longitudinally spaced groups of grinders 49, 50 and 51, 52 with wheels 53, 54, interposed respectively between each pair. This requires three chassis 55, 56, 57, the latter mounting the wheels 53, 54 and bridging the two other chassis which carry the grinders.

Figure 11:
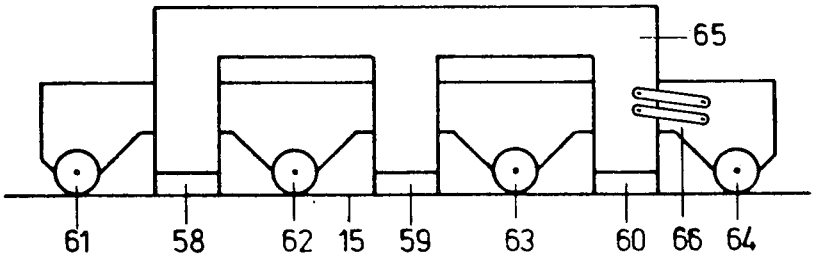

FIG. 11 shows seven contact points provided by a group of three grinders 58, 59, 60 alternating with four rail following wheels 61, 62, 63, 64 of another group. Two chassis 65 and 66 are required. Following the convention of FIGS. 1 to 6, the forces transmitted by these chassis will be equal to 3F and 4F respectively.

It should be noted, however, that the pressure exerted by the wheels which simply roll along the rail may be allowed to be greater than that admissible for the grinders or other abrasive elements.

Figure 12:
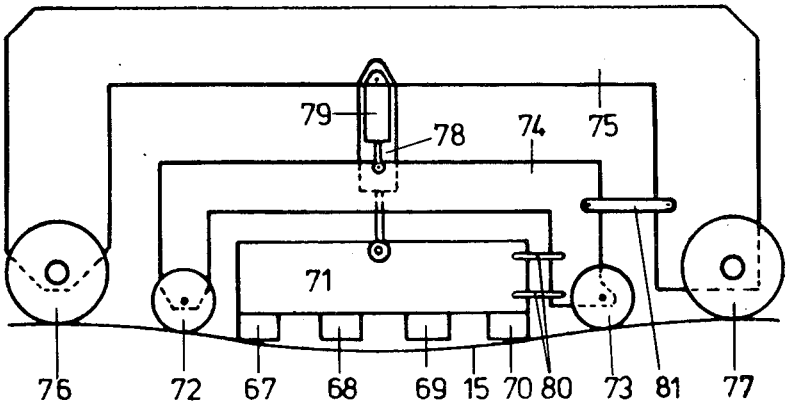
FIG. 12 is a side elevation view of a vehicle carrying rail truing apparatus with a further arrangement of rail contacting elements.

All the arrangements described, and many others, may be supported by a carrier vehicle, as shown diagrammatically in FIG. 12. Here four grinders 67, 68, 69 and 70 are supported by a chassis 71 while two rail following wheels 72 and 73 outside these grinders are carried by a second chassis 74. These two chassis are themselves mounted on a carrier vehicle 75 running on two wheels 76 and 77.

The desired pressure is transmitted from the vehicle 75 independently to the two chassis 71 and 74 by means represented by two jacks 78 and 79. The two chassis are maintained parallel by bar linkage 80. The chassis 74 is linked to the vehicle by a single bar 81 since it is not necessary for there to be parallelism between the line of the points of contact of the wheels 76, 77 and the other members in contact with the rail 15.

Figure 13:
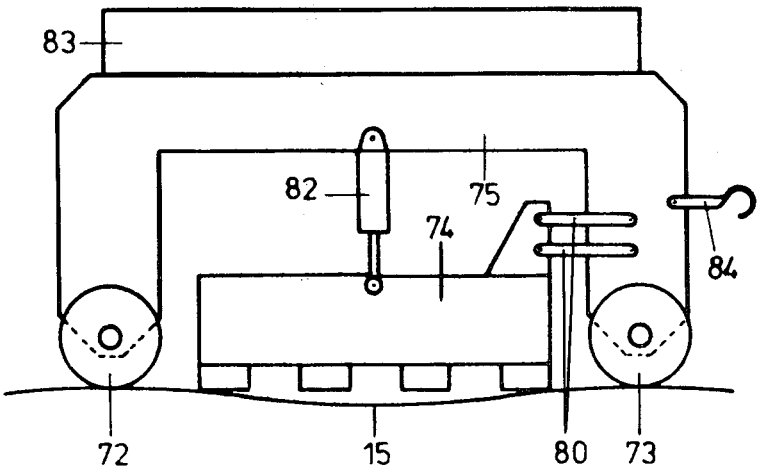
FIG. 13 is a side elevation view of a modification of FIG. 12.

The carrier vehicle may however be dispensed with, provided there are sufficient rail following wheels, or wheels external to the grinders. This latter case is illustrated in FIG. 13, where there are two chassis 74 and 75, the latter of which carries wheels 72 and 73. The chassis are interconnected by parallel bar linkage 80 and also by a single jack 82. This is used to adjust the pressure transmitted to the chassis 74. A tank 83 is mounted on the chassis 75 and is capable of containing a variable quantity of water, for example. This makes it possible to adjust the total loading of the assembly, which will run on the wheels 72 and 73 when drawn by a hook 84 attached to the chassis 75.

Referring to the elevational view of FIG. 14 and the corresponding plan view of FIG. 15, there will now be described an apparatus having two grinders and two rail following wheels independently carried by a common chassis, the unit being mounted on a twin-axle carrier vehicle.

The carrier vehicle 85, running on the track 15 through the intermediary of wheels 86, 87 carries a chassis 88, which itself carries two grinders 89, 90 and two rail following wheels 91, 92.

The vehicle 85 carries the chassis 88 through the intermediary of jacks, such as that shown at 93, connected to a cross-beam 94. It will be understood that in practice equipment symmetrical with that being described runs on the other rail (not shown) and these are interconnected by the beam 94. By raising or lowering the chassis, it is possible either to break all contact between grinders and wheels and the rail, or regulate at will the pressure which the former exert on the latter. Connecting rods such as 95 guide the chassis illustrated and the opposite one (not shown).

The assembly is so designed that the plane of contact (or working plane) common to the two grinders 89 and 90 is and always remains parallel to the line joining the two points of contact of the wheels 91 and 92. However, regulation of the pressure exerted by the wheels on the rail is rendered independent of the regulation of the pressure exerted by the grinders, so that the four points of contact are in reality divided into two groups of two.

The pressure exerted by the wheels is rendered independent of that exerted by the grinders in the following manner. The wheels are connected to the chassis 88 by pivoted supports 96 and 97 of triangular plate-like form, which are in effect bell-crank levers. These are tiltable by the jacks 98 and 99 pivotally connected to the chassis. A pair of connecting rods 100 and 101 and a rocker 102 interconnect the supports 96 and 97 in order to ensure symmetrically equal movement at all times. The wheels 91 and 92, whatever their position, thus retain their intended points of contact with the rail 15 in a plane strictly parallel with the corresponding plane of contact of the grinders. This parallelism may be finely adjusted by adjusting the length of the connecting rod 101, which is extensible. It will be appreciated that having regard to the very slight amplitude of the movements imparted to the supports 96, 97, the non-rotational movement of the wheels is effectively perpendicular to the longitudinal direction of the rail.

Thus, if one of the four points of contact passes over the apex of an undulation, the pressure exerted will not treble but only double that exerted normally by one of such points. Indeed, it will be only twice the pressure exerted by one of the grinders under the action of the jack 93.

For finishing passes, when the undulations have virtually disappeared, it is useful to be able to lock the groups into a rigid assembly, giving in effect a single abrasive shoe of a greater length than any group considered in isolation. This is provided in the embodiment in FIG. 16.

Therein is shown an assembly of three grinders 103, 104, 105 carried in line by a common chassis 106, the whole unit being vertically displaceable and the end grinders 103 and 105 being fixed with respect to the chassis 106. The central grinder 104 is subject to the action of jacks 107 and 108.

Since the grinders used generally have bell-shaped grindstones (as illustrated), they do in fact each have two points of contact with the rail. Thus one can say that the central grinder 104 has two points of contact 104', 104" and that the whole assembly has six points of contact divided into groups of four and two. Since the grinder 104 is supported by the jacks, the pressure exerted by its two points of contact is normally independent of that of the points of contact of the other two grinders. However an additional jack 109 makes it possible to lock this central grinder 104 in any one of a range of positions, as desired, and thus provide an array of grinders all rigid with respect to the chassis that carries them.

Figure 14:
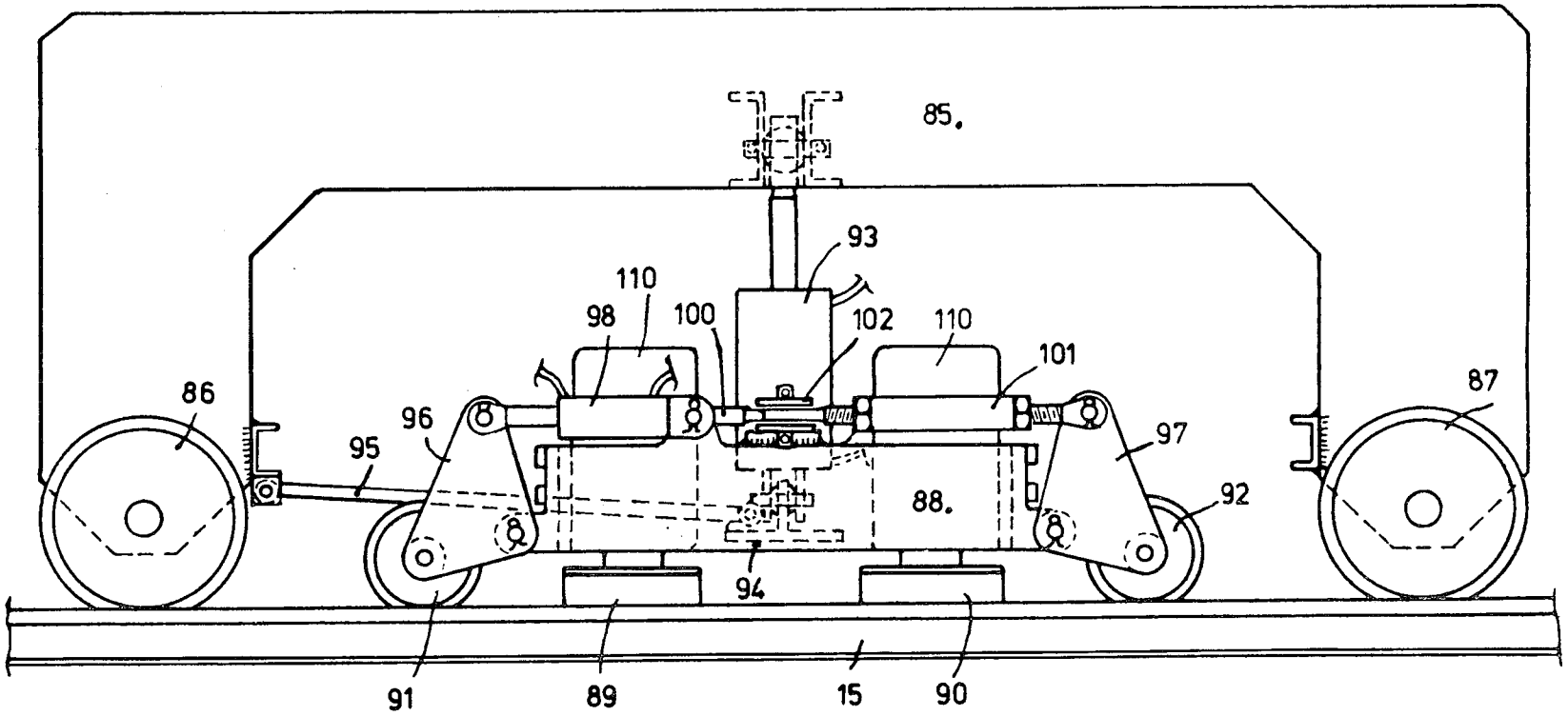
FIG. 14 is a side elevation view in greater structural detail, of a vehicle equipped with rail truing apparatus.
Figure 15:
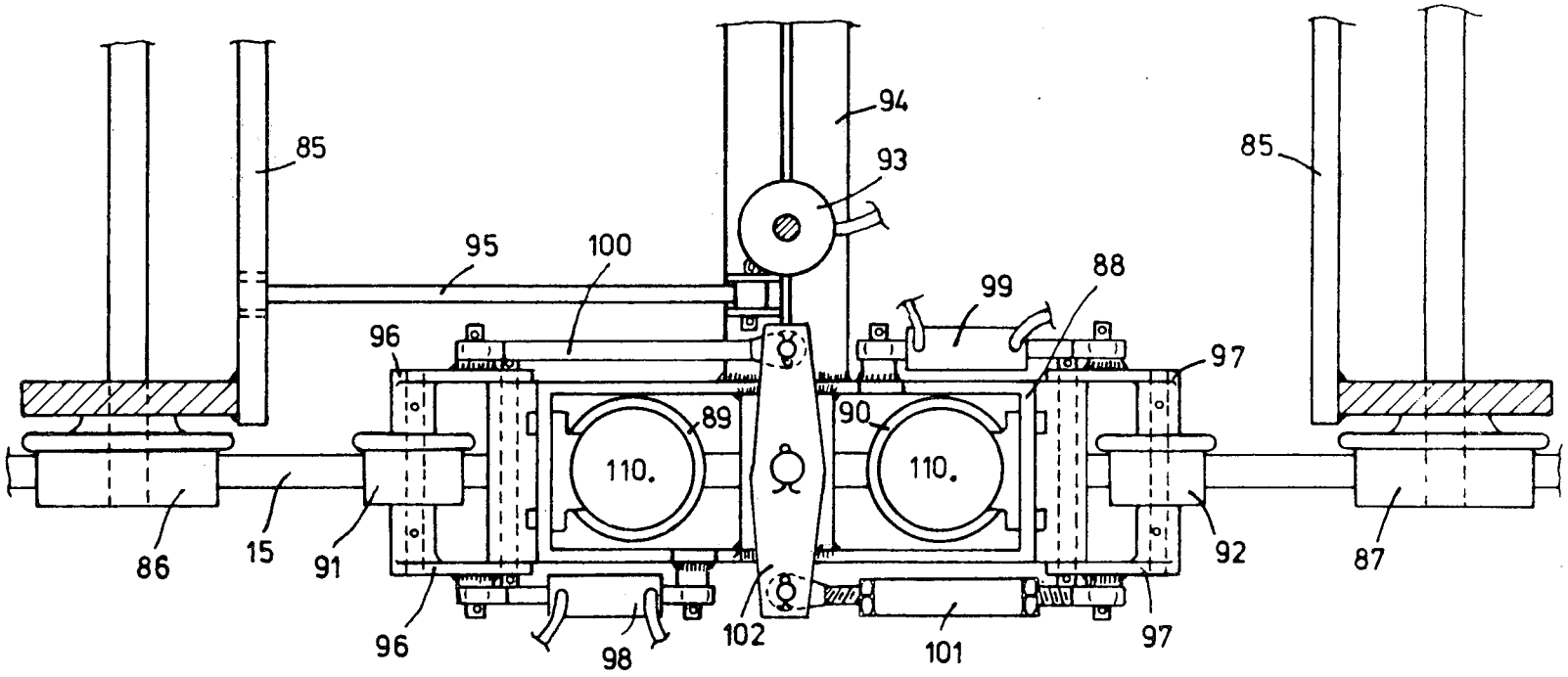
FIG. 15 is a plan view of one-half of the vehicle and apparatus of FIG. 14.
Figure 16:
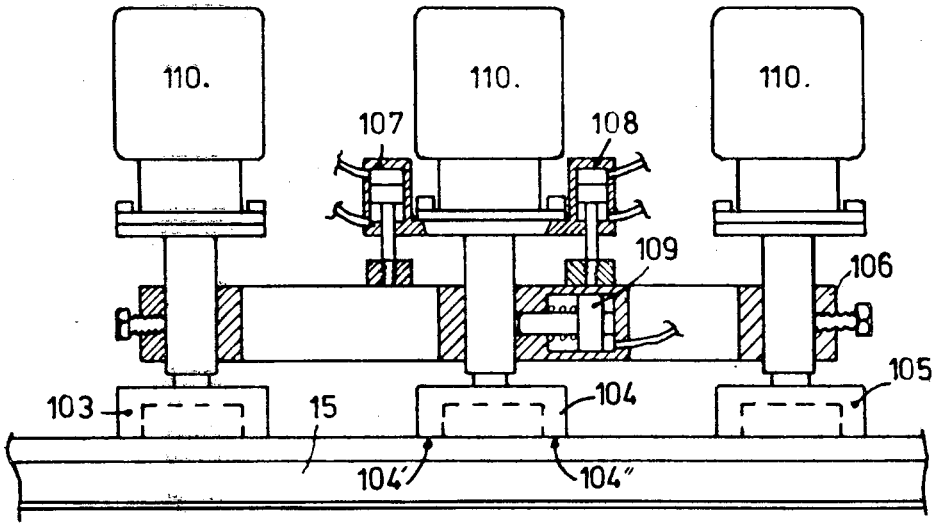
FIG. 16 is a side elevation view of further rail truing apparatus.

In FIGS. 14 to 16, the parts designated 110 are motors that drive the grinders independently.

What is claimed is:

1. Apparatus for the continuous on-track alignment of railway rails, said apparatus comprising a plurality of contact elements constituting points of support of the apparatus on the rail, means dividing the contact elements into three longitudinally aligned groups capable of each moving by itself and parallel to one another, means associated with said groups for causing the same to exert predetermined pressure on the rail which is to be aligned, the contact elements in at least the first of said groups being fixedly arranged therein on a common support and means hingably connecting said groups together so that they are constrained to move parallel to one another, the first group having two contact elements which are abrasive grinding elements, the third group having two contact elements which are abrasive grinding elements, the second group being interposed between the other two groups of abrasive elements and having two contact elements so that between the two abrasive elements of the two groups there is always one contact element.

2. Apparatus as claimed in claim 1 the contact elements of the second group constitute only bearing points.

* * * * *